US008109219B2

(12) United States Patent
Browne et al.

(10) Patent No.: US 8,109,219 B2
(45) Date of Patent: Feb. 7, 2012

(54) ADJUSTABLE THREADING UTENSIL AND STRUCTURE UTILIZING SHAPE MEMORY ACTUATION

(75) Inventors: Alan L. Browne, Grosse Pointe, MI (US); Nancy L. Johnson, Northville, MI (US); Jan H. Aase, Oakland Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 536 days.

(21) Appl. No.: 12/331,350

(22) Filed: Dec. 9, 2008

(65) Prior Publication Data

US 2010/0139539 A1 Jun. 10, 2010

(51) Int. Cl.
*D05B 85/02* (2006.01)
*D05B 85/00* (2006.01)

(52) U.S. Cl. ..... 112/224

(58) Field of Classification Search ..... 112/222–227; 223/99, 102–104

See application file for complete search history.

(56) References Cited

U.S. PATENT DOCUMENTS 3,757,715 A * 9/1973 Spanel et al. ..... 112/221
3,987,839 A * 10/1976 Pace ..... 163/5
4,274,565 A * 6/1981 Russell ..... 223/102
4,385,575 A * 5/1983 Weber ..... 112/224

FOREIGN PATENT DOCUMENTS

JP 401299593 A * 12/1989

* cited by examiner

*Primary Examiner* — Ismael Izaguirre

(57) ABSTRACT

A selectively and reversibly adjustable utensil, aperture forming structure, and stirrup, and methods of geometrically modifying an eye defined by the utensil, the aperture defined by the structure, and the stirrup, utilizing active material actuation, so as to facilitate entraining a filament within the eye or aperture, and securing the filament once entrained.

10 Claims, 3 Drawing Sheets

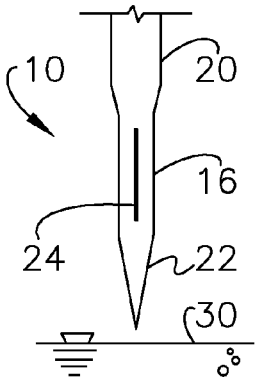
FIG. 3a
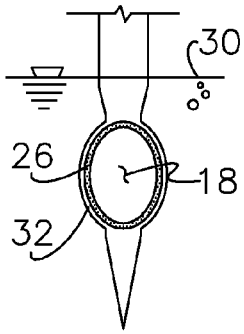
FIG. 3b
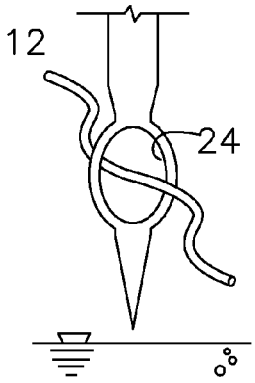
FIG. 3c
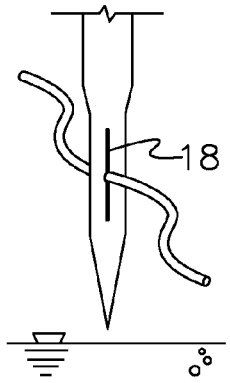
FIG. 3d
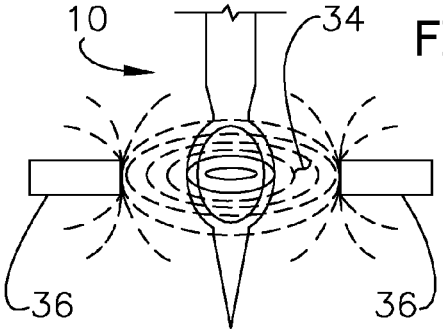
FIG. 4
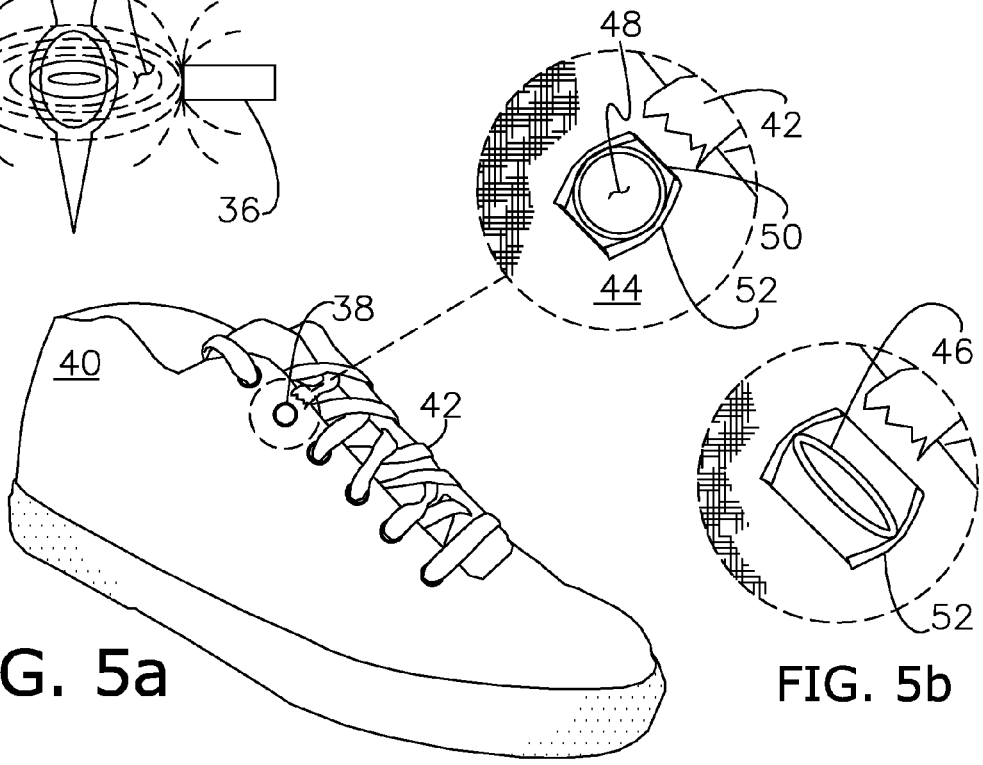
FIG. 5a
FIG. 5b

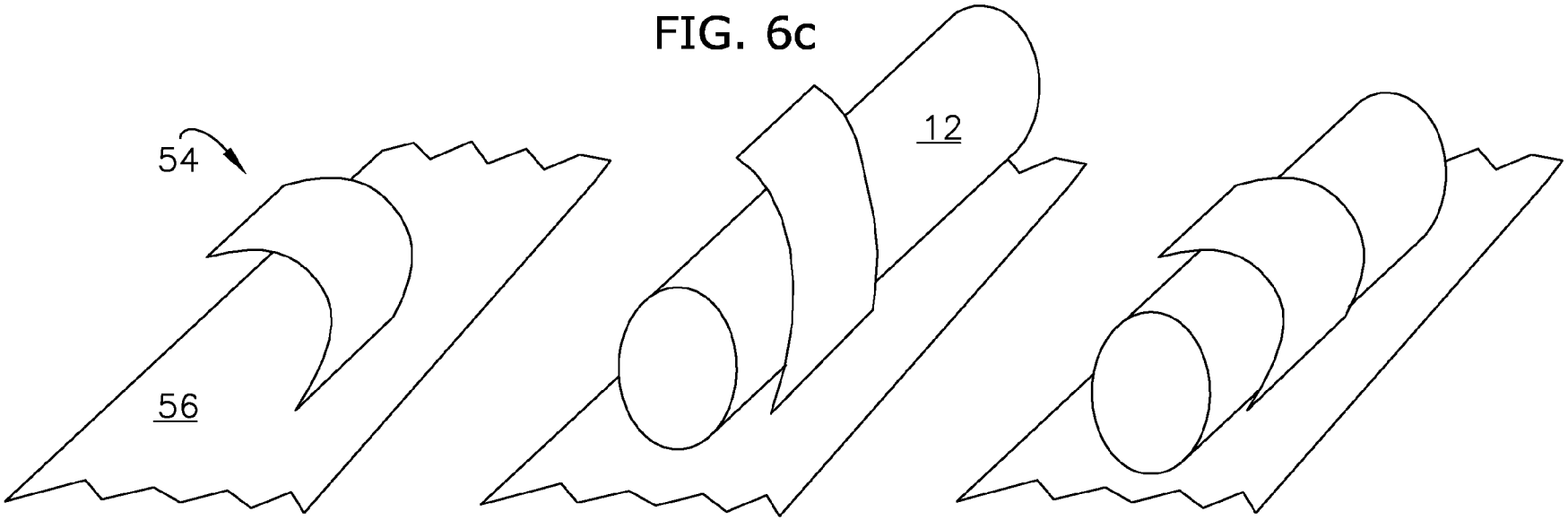
FIG. 6c
FIG. 6d
FIG. 6a
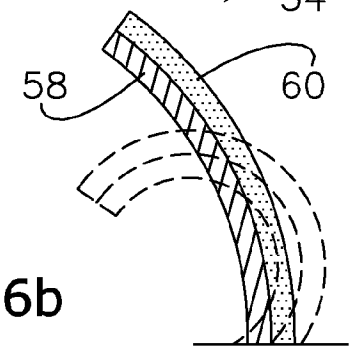
FIG. 6b

ADJUSTABLE THREADING UTENSIL AND STRUCTURE UTILIZING SHAPE MEMORY ACTUATION

BACKGROUND OF THE INVENTION

1. Technical Field

This disclosure generally relates to threading utensils, grommets, eyelets and other structures, and methods of entraining a filament within the same. More particularly, the invention relates to threading utensils, grommets, eyelets, and other structures that utilize shape memory actuation to selectively and reversibly adjust in geometric configuration, so as to facilitate entraining the filament, and securing the filament once entrained.

2. Background Art

Threading utensils, such as needles and the like, have long been developed to facilitate sewing, knitting, and other activities wherein a filament is caused to pass through an aperture (s) or layer(s) of material. As well known in their respective arts, these utensils must themselves be initially entrained with the filament (e.g., thread, lace, yarn, string, cable, wire, etc.), and as such typically define an eye through which the filament is passed. Whereas the utensil must often pass through the material or aperture in repetative manual or machine-driven strokes, conventional utensils typically present an elongated body having a minimal diameter and a tapered end section that converges to a distal point. As a result, the typical eye is likewise of minimal width, which results in the difficult task of passing a thin flexible filament therethrough. Once entrained within the eye, the filament is secured to prevent unwanted withdrawal by doubling it over, twisting, tying a knot therein, or an otherwise method.

Similarly, eyelets (e.g., grommets, and other aperture forming structures) commonly compose articles of manufacture, and help define neatly tailored apertures of fixed geometric shape and dimension. For example, it is appreciated that many articles of clothing (e.g., corsets, etc.) and shoes feature a plurality of eyelets adapted to receive a lace. Like the eyes of the afore-mentioned utensils, however, threading eyelets have often proved difficult due to their typically small size, and once threaded, the filament or lace must be secured to prevent unwanted withdrawal.

BRIEF SUMMARY

The present invention concerns reconfigurable threading utensils, aperture forming structures, and stirrups, which utilize shape memory actuation to adjust in geometric configuration. The invention is useful, among other things, for selectively and reversibly modifying a dimension of a utensil eye or aperture. More particularly, when threading is desired, modification increases the dimension of the eye or aperture, so as to result in a more facilely entrained filament, and once the filament is entrained, the inventive utensil or structure reduces the dimension to apply a holding force thereto. After use, the utensil or eyelet may be again modified so as to facilitate removal of the filament, when desired. Finally, it is appreciated that where sufficient holding force is applied by one or more structures, the invention is also useful for eliminating the need to further manipulate the filament (e.g., tie a knot therein, etc.) to secure the threaded article.

A first aspect of the invention concerns a threading utensil adapted for entraining a filament defining an average cross-sectional diameter. The utensil includes a body including an entraining section. The entraining section, in a first configuration, defines an eye presenting a first dimension, and comprises a shape memory material operable to undergo a reversible change when exposed to or occluded from an activation signal, so as to be activated or deactivated, respectively. As a result of the change, the section is caused to achieve a second configuration wherein the eye presents a second dimension greater than the first and preferably the diameter.

A second aspect of the invention concerns a structure, such as a grommet or eyelet, adapted for entraining a filament defining an average cross-sectional diameter. The structure comprises a conformal body defining an aperture. In a first shape, the aperture presents a first dimension preferably less than the diameter. The structure further includes a shape memory element drivenly coupled to the body, and operable to undergo a change when exposed to or occluded from an activation signal, so as to be activated or deactivated, respectively. The body and material are cooperatively configured such that the body is caused to conform to a second shape wherein a second dimension greater than the first is presented, as a result of the change.

A third aspect of the invention concerns a method of lacing and securing a filament having an average cross-sectional diameter. The method initially includes positioning the filament adjacent at least one stirrup projecting from a surface. The stirrup comprises a shape memory material, and presents a first configuration wherein a distal edge is defined and spaced from the surface a distance greater than the diameter. The method includes exposing the material to an activation signal, and bending the stirrup so as to achieve a second configuration, wherein the edge is spaced from the surface a distance less than the diameter, resulting in the application of a holding force to the filament.

A fourth aspect of the invention concerns a method of threading a filament within an aperture presenting a first dimension, and securing the filament when threaded. The aperture is defined by a conformal structure comprising shape memory material, and the filament defines an average cross-sectional diameter greater than the first dimension. The method includes the initial steps of exposing at least a portion of the structure to an activation signal sufficient to activate the material, and modifying the aperture so as to present a second dimension greater than the diameter, as a result of exposing the body to the signal. The filament is inserted within the aperture, when the aperture is modified to present the second dimension. Once inserted, exposure to the signal is terminated, so as to cause the aperture to revert back to the first dimension and apply a holding force to the filament.

Other aspects and advantages of the present invention, including the employment of shape memory alloy both in its austenitic and martensitic deactivated phases, and other active materials for actuating various configurations of conformable utensils, and structures will be apparent from the following detailed description of the preferred embodiment (s) and the accompanying drawing figures.

BRIEF DESCRIPTION OF THE SEVERAL VIEWS OF THE DRAWING

A preferred embodiment(s) of the invention is described in detail below with reference to the attached scaled drawing figures, wherein:

FIG. 3*a* is an elevation view of a threading utensil having a conformal entraining section adjacent the tip, prior to exposing the section to a heated fluid, in accordance with a preferred embodiment of the invention;

FIG. 3*b* is an elevation view of the utensil shown in FIG. 3*a*, wherein the section presents a second configuration after exposure to the fluid;

FIG. 3*c* is an elevation view of the utensil shown in FIGS. 3*a-b*, wherein the utensil has been withdrawn from the heated fluid and a filament has been passed through the modified aperture;

FIG. 3*d* is an elevation view of the utensil shown in FIGS. 3*a-c*, wherein the utensil has cooled and reverted back to its initial condition, so as to apply a holding force to the filament;

FIG. 4 is an elevation view of first and second spaced magnets, and a utensil having a reconfigurable entraining section comprising ferromagnetic shape memory alloy material positioned within a magnetic field defined by the magnets, in accordance with a preferred embodiment of the invention;

FIG. 5*a* is a perspective view of a shoe having reconfigurable eyelets, and an enlarged inset of the conformal eyelet structure having coupled thereto a shape memory wire band, in accordance with a preferred embodiment of the invention;

FIG. 5*b* is a plan view of the structure shown in FIG. 5*a*, wherein the band has been lengthened, so as to cause the modification of the structure;

FIG. 6*a* is a perspective view of a bent stirrup in a first configuration attached to a surface, in accordance with a preferred embodiment of the invention;

FIG. 6*b* is a cross-section of the stirrup shown in FIG. 6*a*, particularly illustrating superjacent shape memory material and biasing spring steel layers;

FIG. 6*c* is a perspective view of the stirrup shown in FIGS. 6*a-b*, after being modified to a second configuration, and a filament positioned adjacent to the surface and stirrup, in accordance with a preferred embodiment of the invention; and FIG. 6*d* is a perspective view of the stirrup shown in FIGS. 6*a-c*, wherein the stirrup has reverted back to the first configuration and applies a hold force to the filament.

DETAILED DESCRIPTION

Figure 1:
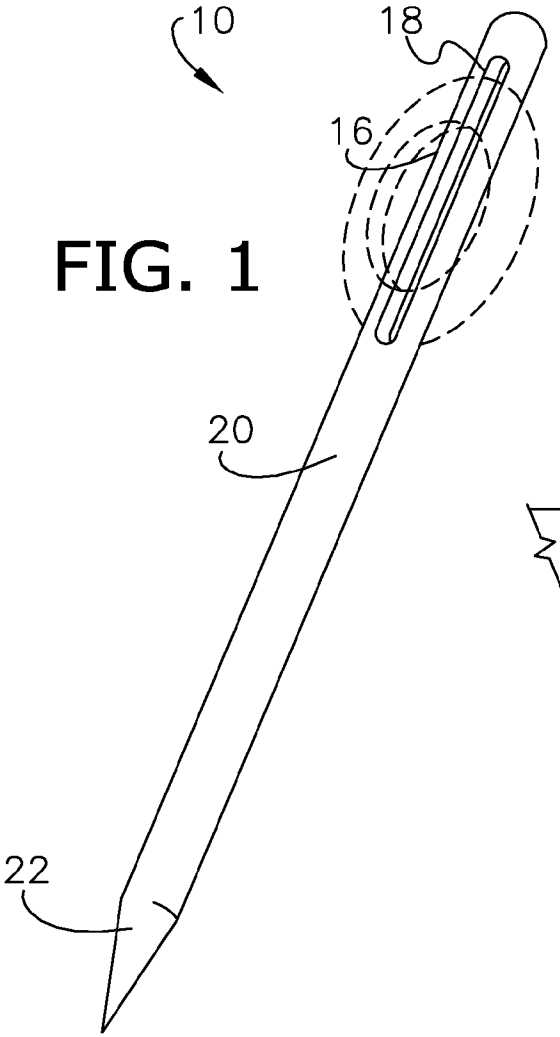
FIG. 1 is a perspective view of threading utensil presenting a conformal entraining section and eye, in accordance with a preferred embodiment of the invention.

As shown in FIGS. 1-4, the invention concerns a threading utensil 10 adapted for entraining a filament 12, such as sewing thread, lace, yarn, string, cable, or conductive wire. Once entrained, the utensil 10 may be manually or machine-driven by a user 14 (FIGS. 2*a-c*), so that the filament 12 is threaded as desired. The inventive utensil 10 is able to toggle between at least one configuration wherein entraining the filament 12 is facilitated, and at least one configuration wherein the filament 12 is preferably secured once entrained; and to that end, includes a modifiable entraining section 16 that defines an eye or aperture 18 through which a portion of the filament 12 is passed (FIG. 1). In the illustrated embodiment the utensil 10 presents a sewing (e.g., needlecraft, darning, embroidery, stitching, etc.) needle, wherein the filament 12 is sewing thread (e.g., yarn, etc.); however, it is certainly appreciated that the advantages and features of the present invention are not limited to the illustrated embodiment, and may be applied to any other utensil typically entrained by a filament. For example, the utensil 10 may be a blade, awl, or fishing hook; and the filament 12 may be fishing line, or a conductive wire to be placed, for example, in an automotive cable harness.

In the illustrated embodiment, the utensil 10 further defines shaft and distal tip sections 20,22 (FIG. 1). The shaft and tip sections 20,22 cooperatively present a slender, cylindrical piece of solid material, such as stainless steel. To provide corrosion resistance the shaft and tip sections 20,22 may be manufactured from high carbon steel wire, and either nickel or gold plated. The shaft section 20 (i.e., "shaft" or "barrel") presents the main body of the utensil 10 and is intermediate the tip 22 and entraining section 16. The shaft 20 may be solid, perforated, or hollow. The tip section (i.e., "tip") 22 presents a sloped surface that creates a sharp point, but in some applications may be intentionally blunt. The tip 22 may present any configuration, including a double bevel, wherein the first bevel creates the tapered end and the second produces the sharpness of the tip 22. Finally, it is appreciated that the features and benefits of the present invention are applicable, irrespective of the utensil gauge.

In the illustrated embodiment, the entraining section 16 coaxially extends from the shaft 20 and preferably presents an outer diameter congruent to or less than the shaft diameter, in a first permanent configuration (FIG. 1). As previously mentioned, the entraining section 16 is reversibly adjustable, so as to modify its geometric configuration. The geometric modification selectively increases or decreases a dimension, such as the width, or cross-sectional area, of the eye 18. In the larger eye configuration (FIGS. 2*b*, 3*c*, and 4), the dimension is greater than the average cross-sectional diameter of the filament 12, and more preferably greater than twice the diameter, so that the filament 12 is able to facilely pass through the eye 18. In the reduced eye configuration (FIGS. 2*c*, 3*d*), the eye 18 is preferably configured such that the inner walls 24 (FIG. 3*c*) of the section 16 oppositely engage the filament 12, thereby exerting a holding force thereupon. More preferably, in the reduced configuration, the dimension is generally zero (FIG. 3*a*), such that the walls 24 work to become adjacent and are able to apply a holding force to a filament 12 of any size. To improve holding, the eye 18 may present a compressible inner engagement layer (not shown) that conforms to the contours of the filament 12.

In the illustrated embodiment, the entraining section 16 presents a maximum outer diameter greater than the shaft diameter, when in the enlarged eye configuration (FIGS. 2*b* and 3*c*); however, it is appreciated that the eye 18 may geometrically adjust without altering the outer diameter of the entraining section 16, such that utilizing the utensil 10 for threading in either entraining section configuration is facilitated. More preferably, the eye 18 is reversibly adjustable between a default (e.g., "normal" or "deactivated") position and a plurality of modified positions, so as to facilitate and secure a plurality of filaments 12 having differing characteristics (e.g., diameters, textures, cross-sectional shapes, compressabilities, etc.). For example, a variable degree of modification may be proportional to the degree of exposure to the signal.

Each of the plural achievable configurations is reversible, but permanent, in an ambient environment. To effect this function, the entraining section 16 employs an active, and more preferably, a shape memory material 26 (FIG. 3*b*). The section 16 may consist entirely of the active material 26, or further present a combination of active and non-active materials, intermittently, intermingled, or superjacently configured. In another alternative, the entraining section 16 may comprise a plurality of antagonistically configured active materials, wherein a first is actuated to drive modification, and the other is actuated to reverse modification.

The entraining section 16 may be fixedly attached to the remainder of the utensil 10 through a suitable method of joining (e.g., welding, bonding, etc.). Alternatively, the tip, shaft and entraining sections 20,16,22 may be integrally formed (e.g., casted, etc.), and moreover, present a homogenous constitution including the shape memory material 26. In this configuration, it is appreciated that further selective modification may be caused in the utensil 10; for example, the tip 22 may be selectively blunted to facilitate handling during entrainment.

As used herein the term "active material" shall be afforded its ordinary meaning as understood by those of ordinary skill in the art, and includes any material or composite that exhibits a reversible change in a fundamental (e.g., chemical or intrinsic physical) property, when exposed to an external signal source. Thus, active materials shall include those compositions that can exhibit a change in stiffness properties, shape and/or dimensions in response to the activation signal, which can take the type for different active materials, of electrical, magnetic, thermal and like fields.

Suitable active materials for use with the present invention include but are not limited to shape memory materials such as shape memory alloys (SMA), shape memory polymers (SMP), shape memory ceramics, electroactive polymers (EAP), and ferromagnetic SMA'S. Shape memory materials generally refer to that class of active materials that have the ability to remember the original value of at least one attribute, such as shape, which can subsequently be recalled by applying an external stimulus. As such, deformation from the original shape is a permanent, but reversible, condition. In this manner, shape memory materials can change to the trained shape in response to an activation signal. Other active materials suitable for use, but not further discussed herein, include electrorheological (ER) compositions, magnetorheological (MR) compositions, dielectric elastomers, piezoelectric polymers, piezoelectric ceramics, various combinations of the foregoing materials, and the like.

Shape memory alloys (SMA's) generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or martensite phase, shape memory alloys can be plastically deformed and upon exposure to some higher temperature will transform to an austenite phase, or parent phase, returning to their shape prior to the deformation. Materials that exhibit this shape memory effect only upon heating are referred to as having one-way shape memory. Those materials that have been trained to also exhibit shape memory upon re-cooling are referred to as having two-way shape memory behavior.

Shape memory alloys exist in several different temperature-dependent phases. The most commonly utilized of these phases are the so-called marten site and austenite phases discussed above. In the following discussion, the martensite phase generally refers to the more deformable, lower temperature phase whereas the austenite phase generally refers to the more rigid, higher temperature phase. When the shape memory alloy is in the martensite phase and is heated, it begins to change into the austenite phase. The temperature at which this phenomenon starts is often referred to as austenite start temperature ($A_s$). The temperature at which this phenomenon is complete is called the austenite finish temperature ($A_f$).

When the shape memory alloy is in the austenite phase and is cooled, it begins to change into the martensite phase, and the temperature at which this phenomenon starts is referred to as the martensite start temperature ($M_s$). The temperature at which austenite finishes transforming to martensite is called the martensite finish temperature ($M_f$). Generally, the shape memory alloys are softer and more easily deformable in their martensitic phase and are harder, stiffer, and/or more rigid in the austenitic phase. In view of the foregoing, a suitable activation signal for use with shape memory alloys is a thermal activation signal having a magnitude to cause transformations between the martensite and austenite phases.

Shape memory alloys can exhibit a one-way shape memory effect, an intrinsic two-way effect, or an extrinsic two-way shape memory effect depending on the alloy composition and processing history. Annealed shape memory alloys typically only exhibit the one-way shape memory effect. Sufficient heating subsequent to low-temperature deformation of the shape memory material will induce the martensite to austenite type transition, and the material will recover the original, annealed shape. Hence, one-way shape memory effects are only observed upon heating. Active materials comprising shape memory alloy compositions that exhibit one-way memory effects do not automatically reform, and will likely require an external mechanical force to reform the shape that was previously suitable for airflow control.

Intrinsic and extrinsic two-way shape memory materials are characterized by a shape transition both upon heating from the martensite phase to the austenite phase, as well as an additional shape transition upon cooling from the austenite phase back to the martensite phase. Active materials that exhibit an intrinsic shape memory effect are fabricated from a shape memory alloy composition that will cause the active materials to automatically reform themselves as a result of the above noted phase transformations. Intrinsic two-way shape memory behavior must be induced in the shape memory material through processing. Such procedures include extreme deformation of the material while in the martensite phase, heating-cooling under constraint or load, or surface modification such as laser annealing, polishing, or shot-peening. Once the material has been trained to exhibit the two-way shape memory effect, the shape change between the low and high temperature states is generally reversible and persists through a high number of thermal cycles. In contrast, active materials that exhibit the extrinsic two-way shape memory effects are composite or multi-component materials that combine a shape memory alloy composition that exhibits a one-way effect with another element that provides a restoring force to reform the original shape.

The temperature at which the shape memory alloy remembers its high temperature form when heated can be adjusted by slight changes in the composition of the alloy and through heat treatment. In nickel-titanium shape memory alloys, for instance, it can be changed from above about 100° C. to below about −100° C. The shape recovery process occurs over a range of just a few degrees and the start or finish of the transformation can be controlled to within a degree or two depending on the desired application and alloy composition. The mechanical properties of the shape memory alloy vary greatly over the temperature range spanning their transformation, typically providing the system with shape memory effects, superelastic effects, and high damping capacity.

Suitable shape memory alloy materials include, without limitation, nickel-titanium based alloys, indium-titanium based alloys, nickel-aluminum based alloys, nickel-gallium based alloys, copper based alloys (e.g., copper-zinc alloys, copper-aluminum alloys, copper-gold, and copper-tin alloys), gold-cadmium based alloys, silver-cadmium based alloys, indium-cadmium based alloys, manganese-copper based alloys, iron-platinum based alloys, iron-platinum based alloys, iron-palladium based alloys, and the like. The alloys can be binary, ternary, or any higher order so long as the alloy composition exhibits a shape memory effect, e.g., change in shape orientation, damping capacity, and the like.

Thus, for the purposes of this invention, it is appreciated that SMA's exhibit a modulus increase of 2.5 times and a dimensional change of up to 8% (depending on the amount of pre-strain) when heated above their martensite to austenite phase transition temperature. It is appreciated that thermally induced SMA phase changes are one-way so that a biasing force return mechanism (such as a spring) would be required to return the SMA to its starting configuration once the applied field is removed. Joule heating can be used to make the entire system electronically controllable.

Stress induced phase changes in SMA, caused by loading and unloading, are, however, two way by nature. Application of sufficient stress when an SMA is in its austenitic phase will cause it to change to its lower modulus martensitic phase in which it can exhibit up to 8% of "superelastic" deformation. Removal of the applied stress will cause the SMA to switch back to its austenitic phase in so doing recovering its starting shape and higher modulus.

Ferromagnetic SMA's (FSMA's), which are a sub-class of SMAs, may also be used in the present invention. These materials behave like conventional SMA materials that have a stress or thermally induced phase transformation between martensite and austenite. Additionally FSMA's are ferromagnetic and have strong magnetocrystalline anisotropy, which permit an external magnetic field to influence the orientation/fraction of field aligned martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. One-way shape memory is most useful for rail filling applications. External magnetic fields are generally produced via soft-magnetic core electromagnets in automotive applications, though a pair of Helmholtz coils may also be used for fast response.

Shape memory polymers (SMP's) generally refer to a group of polymeric materials that demonstrate the ability to return to a previously defined shape when subjected to an appropriate thermal stimulus. Shape memory polymers are capable of undergoing phase transitions in which their shape is altered as a function of temperature. Generally, SMP's have two main segments, a hard segment and a soft segment. The previously defined or permanent shape can be set by melting or processing the polymer at a temperature higher than the highest thermal transition followed by cooling below that thermal transition temperature. The highest thermal transition is usually the glass transition temperature ($T_g$) or melting point of the hard segment. A temporary shape can be set by heating the material to a temperature higher than the $T_g$ or the transition temperature of the soft segment, but lower than the $T_g$ or melting point of the hard segment. The temporary shape is set while processing the material at the transition temperature of the soft segment followed by cooling to fix the shape. The material can be reverted back to the permanent shape by heating the material above the transition temperature of the soft segment. For example, the permanent shape of the polymeric material may be an eyelet of a very narrow elongated geometry, while the temporary shape may be an eyelet of a substantially round geometry.

The temperature needed for permanent shape recovery can be set at any temperature between about −63° C. and about 120° C. or above. Engineering the composition and structure of the polymer itself can allow for the choice of a particular temperature for a desired application. A preferred temperature for shape recovery is greater than or equal to about −30° C., more preferably greater than or equal to about 0° C., and most preferably a temperature greater than or equal to about 50° C. Also, a preferred temperature for shape recovery is less than or equal to about 120° C., and most preferably less than or equal to about 120° C. and greater than or equal to about 80° C.

Suitable shape memory polymers include thermoplastics, thermosets, interpenetrating networks, semi-interpenetrating networks, or mixed networks. The polymers can be a single polymer or a blend of polymers. The polymers can be linear or branched thermoplastic elastomers with side chains or dendritic structural elements. Suitable polymer components to form a shape memory polymer include, but are not limited to, polyphosphazenes, poly(vinyl alcohols), polyamides, polyester amides, poly(amino acid)s, polyanhydrides, polycarbonates, polyacrylates, polyalkylenes, polyacrylamides, polyalkylene glycols, polyalkylene oxides, polyalkylene terephthalates, polyortho esters, polyvinyl ethers, polyvinyl esters, polyvinyl halides, polyesters, polylactides, polyglycolides, polysiloxanes, polyurethanes, polyethers, polyether amides, polyether esters, and copolymers thereof. Examples of suitable polyacrylates include poly(methyl methacrylate), poly(ethyl methacrylate), ply(butyl methacrylate), poly (isobutyl methacrylate), poly(hexyl methacrylate), poly(isodecyl methacrylate), poly(lauryl methacrylate), poly(phenyl methacrylate), poly(methyl acrylate), poly(isopropyl acrylate), poly(isobutyl acrylate) and poly(octadecyl acrylate). Examples of other suitable polymers include polystyrene, polypropylene, polyvinyl phenol, polyvinylpyrrolidone, chlorinated polybutylene, poly(octadecyl vinyl ether) ethylene vinyl acetate, polyethylene, poly(ethylene oxide)-poly (ethylene terephthalate), polyethylene/nylon (graft copolymer), polycaprolactones-polyamide (block copolymer), poly (caprolactone)dimethacrylate-n-butyl acrylate, poly (norbornyl-polyhedral oligomeric silsequioxane), polyvinylchloride, urethane/butadiene copolymers, polyurethane block copolymers, styrene-butadiene-styrene block copolymers, and the like.

Thus, for the purposes of this invention, it is appreciated that SMP's exhibit a dramatic drop in modulus when heated above the glass transition temperature of their constituent that has a lower glass transition temperature. If loading/deformation is maintained while the temperature is dropped, the deformed shape will be set in the SMP until it is reheated while under no load under which condition it will return to its as-molded shape. While SMP's could be used variously in block, sheet, slab, lattice, truss, fiber or foam forms, they require continuous power to remain in their lower modulus state.

Figure 2A:
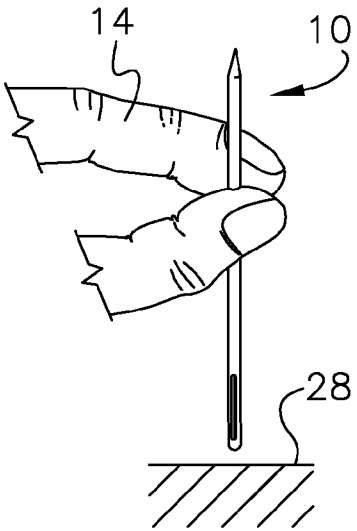
FIG. 2*a* is an elevation view of a threading utensil having a conformal entraining section adjacent the head, prior to the manual application of a stress signal by a user, in accordance with a preferred embodiment of the invention.
Figure 2B:
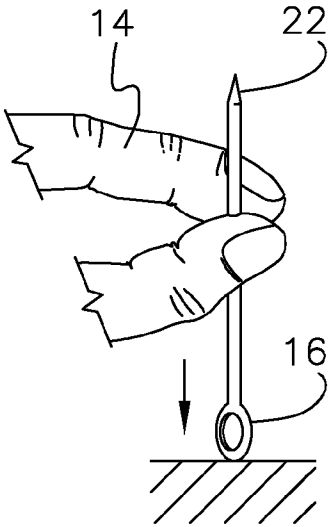
FIG. 2*b* is an elevation view of the utensil shown in FIG. 2*a*, after the application of the stress signal and the entraining section has been caused to conform.
Figure 2C:
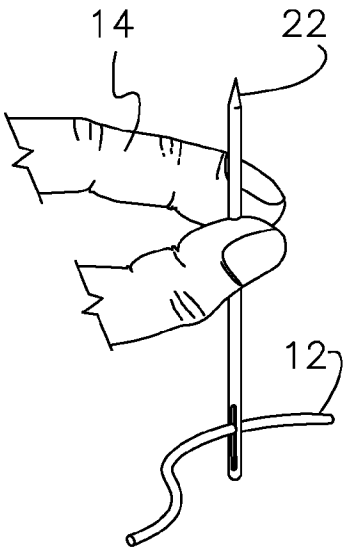
FIG. 2*c* is an elevation view of the utensil shown in FIGS. 2*a-b*, after a portion of a filament has been passed through the eye, and the section has been caused to revert back to its initial state, so as to apply a holding force to the filament.

Considering now an example embodiment in which the active material is an SMA, where the entraining section 16 comprises shape memory alloy material 26 in a deactivated austenite phase, the material 26 may be caused to transition to its martensite phase by applying a stress load signal to the section 16 (FIGS. 2*a-c*). In FIG. 2*b*, for example, a user 14 manually applies the stress load signal by pressing the utensil 10 against a hard surface 28. Once in its softer martensite phase, the entraining section 16 is further compressed against the surface 28, so as to cause it to deform as desired. More particularly, the eye 18 is preferably caused to widen towards a more circular shape that facilitates entry of the filament 12, as shown in FIG. 2*b*. Once the filament 12 is entrained, the applied stress is terminated, causing the section 16 to return to its austenite phase and "memorized" shape (FIG. 2*c*).

Alternatively, and as shown in FIGS. 3*a-d*, the material 26 may be a shape memory alloy in a deactivated martensite phase. In this configuration, the section 16 is modified by applying a thermal activation signal to the material 26. For example, and as shown in the illustrated embodiment, the material 26 may be exposed to a heated fluid 30 (e.g., boiling water, heated blown air, etc.) having sufficient enthalpy. FIGS. 3*a-d* show a utensil 10 having an entraining section 16 adjacent the tip 22 being progressively dipped into a boiling liquid. In FIG. 3*b*, the section 16 has been submerged in the fluid 30, and heat energy has caused the material 26 to transition to its austenite phase and the section 16 to reconfigure to its memorized shape. As shown in FIG. 3*b*, the second or reconfigured shape may result in an ellipsoidal eye 18 having a greater lateral dimension than the first shape. The modified utensil 10 is then removed from the fluid 30 and entrained by the filament 12 (FIG. 3*c*), within the period in which the temperature of the entraining section 16 remains above its austenite finish temperature. After a portion of the filament 12 is passed through the eye 18, the section 16 is allowed to cool to a temperature below the austenite start temperature, so that the material 26 returns to the martensite phase (FIG. 3*d*).

In this configuration, the entraining section 16 includes a biasing element 32 configured to bias the section 16 towards the first shape or original configuration. The biasing element 32 may consist of spring steel externally (FIG. 3*b*) or internally overlaying the material 26 and able to be conformed by the austenitic shape. That is to say, the biasing element 32 produces a force sufficient to overcome the elastic modulus of the material 26 when in the martensite phase, but not the austenite phase. As such, the entraining section 16 is caused to return to the original configuration, when cooled to return to the martensite phase (FIG. 3*d*). Alternatively, the biasing element 32 may consists of an elastic outer layer that stretches to store potential energy in the enlarged eye configuration.

In another embodiment, the material 26 may be a ferromagnetic shape memory alloy in a normally (i.e., deactivated) martensite phase, but otherwise configured as shown in FIG. 3*a*. In this configuration, the heated fluid 30 or medium is replaced by a magnetic field 34 produced for example by fixed magnets 36 spaced upon a surface (FIG. 4). Activation of the shape memory effect is caused by sufficiently positioning the section 16 within the influence of the field 34. In this configuration, a non-metallic biasing element 32, such as an elastic media, is preferably provided to autonomously return the section 16 to the original configuration.

In the second aspect, the features and advantages of the invention are applied to a reconfigurable aperture lining/forming structure 38, such as a grommet, eyelet or the like, composing an article of manufacture 40. As shown in FIGS. 5*a* and 5*b*, for example, at least one, and more preferably a plurality of collimated inventive eyelets 38 may compose a shoe 40 and be adapted to receive a lace 42, as is known in the art. Like the entraining section 16 above, the inventive structure 38 is modifiable between a first configuration wherein threading the lace 42 is facilitated (FIG. 5*a*), and a second configuration (FIG. 5*b*) wherein a holding force is preferably applied to the lace 42, once threaded. As such, the structure 38 is incorporated into the article 40 via an elastic and/or otherwise pliable media 44. It is appreciated that the article of manufacture 40 may also be one of articles of clothing, cable harnesses, tied-down covers, or sporting, boating, or hiking equipment.

In the illustrated embodiment the structure 38 includes a conformal body 46 that cooperates with the media 44 to define an aperture 48 through which the filament 12 is selectively able to pass (FIGS. 5*a-b*). In the shape or configuration shown in FIG. 5*b*, the aperture 48 defines a first dimension less than the diameter of the filament 12; and in a second shape or configuration, the first dimension is modified so as to achieve a second dimension greater than the diameter (FIG. 5*a*). Alternatively, it is appreciated that the dimension may initially be greater and then caused to transition to a second value smaller than the diameter through active material actuation.

To effect modification, the structure 38 includes an active material element 50, such as the shape memory band shown in FIGS. 5*a-b*. The band 50 is drivenly coupled to the body 46, and as previously described, operable to undergo a change in fundamental property when exposed to a thermal activation signal. The change in material property directly results in the modification of the aperture 48. For example, where the change in property results in a change in shape or dimension of the element 50, the element 50 and body 46 may be integrally formed of an SMP.

Alternatively, the element 50 may function to apply a sustained force upon the conformal body 46. For example, and as shown in the illustrated embodiment, the band 50 may encircle and engage opposite halves of the body 46, such that its contraction causes the body 46 to widen in lateral dimension (compare FIGS. 5*a* and 5*b*). In this configuration, an SMA element 50 is preferred. More preferably, the areas of engagement between the band 50 and body 46 are increased by introducing upper and lower engaging members 52 intermediate the band 50 and body 46. The preferred members 52 are formed of inelastic material, so that the contraction of the band 50 more efficiently works to conform the body 46. In one embodiment, the members 52 may present external sleeves surrounding the engaging portions of the band 50.

Where the active material element 50 is to be thermally activated, a signal may be caused by passing an electric current through its resistance. In this regard, first and second electric leads (not shown) may be connected to the band 50 preferably at the elevational midline, such that current flow equilibrates between the upper and lower paths defined by the band 50. This configuration is suitable, for example, where the structure 38 presents an electrical connector. In articles of manufacture not conducive to Joule heating, it is appreciated that a thermal activation signal may be externally generated and supplied, for example, by a heat source (also not shown), such as a heater, oven, or blow dryer all configured to heat the element 50 through convection heating.

In the third aspect of the invention, another method of facilitating threading and securing a filament 12 is presented. In this configuration, at least one and more preferably a plurality of inventive stirrups 54 are each reconfigurable between first and second shapes, and emanate from a surface 56 (FIGS. 6*a-d*). In the first (e.g., deactivated) shape, the stirrup 54 preferably presents a planar body and a longitudinally bent configuration defined by a first radius of curvature. The stirrup 54 defines a distal edge spaced from the surface 56 a first distance less than the diameter of the filament 12. Like the structure 38, the stirrup(s) 54 may compose an article of manufacture (not shown), and the surface 56, which may or may not be elastic, may represent the outer surface of the article. In the second shape, the stirrup 54 is caused to achieve a straight or longitudinally bent configuration defined by a second radius greater than the first, such that the edge is spaced from the surface 56 a distance greater than the diameter of the filament 12.

Like the utensil 10, and aperture structure 38, modification of the stirrup 54 is driven by active material actuation. For example and as shown in FIGS. 6*a-d*, the stirrup 54 may generally consist of shape memory material, such as a shape memory polymer having at least one transition temperature and memorized shape. Alternatively, the stirrup 54 may comprise superjacent layers of active and non-active materials; for example, and as best shown in FIG. 6*b*, a radially inner layer 58 of spring steel may be overlaid by a layer 60 comprising shape memory alloy. The spring steel and SMA layers 58,60 are cooperatively configured such that the stirrup 54 is caused to achieve the straighter second shape when the SMA layer 60 is activated from the martensite to the austenite phase; that is to say, the SMA layer 60 produces an activation force greater than the spring modulus of the steel layer 58. The steel and SMA layers 58,60 are further configured such that the stirrup 54 is caused to revert back to the original or first shape when the SMA layer 60 is deactivated; in this regard, the potential energy and spring modulus of the steel layer 58 overcome the elastic modulus of the SMA layer 60 in the martensite phase.

Thus, in operation, the stirrup 54 is first caused to achieve the austenite phase and second shape; and the filament 12 is then positioned adjacent the stirrup 54, as shown in FIG. 6*c*. Next, the stirrup 54 is occluded from the activation signal, so as to deactivate material 26 and cause the stirrup 54 to transition back to the first shape. More particularly, the SMA layer 58 when deactivated is caused to stretch (which further accelerates transition to the martensite phase) and conform by the biasing mechanism 32. As a result, the stirrup 54 engages, so as to apply a holding force to, the adjacently positioned filament 12, as it tries to revert back to the first shape.

It is appreciated that this invention has been described with reference to exemplary embodiments; and it is understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out this invention, but that the invention will include all embodiments falling within the scope of the appended claims.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

What is claimed is:

1. A utensil adapted for more facilely entraining a filament, wherein the filament defines an average cross-sectional diameter, said utensil comprising:

a body including an entraining section, wherein the entraining section, in a first configuration, defines an eye presenting a first dimension, wherein the section comprises an active material operable to undergo a reversible change when exposed to or occluded from an activation signal, so as to be activated and deactivated, respectively, and wherein the section is caused to achieve a second configuration defining an eye presenting a second dimension greater than the diameter, as a result of the change, wherein the active material is a ferromagnetic shape memory alloy in a deactivated martensite phase, and the signal is a magnetic field.

2. A utensil adapted for more facilely entraining a filament, wherein the filament defines an average cross-sectional diameter, said utensil comprising:

a body including an entraining section, wherein the entraining section, in a first configuration, defines an eye presenting a first dimension, wherein the section comprises an active material operable to undergo a reversible change when exposed to or occluded from an activation signal, so as to be activated and deactivated, respectively, and wherein the section is caused to achieve a second configuration defining an eye presenting a second dimension greater than the diameter, as a result of the change, wherein the entraining section includes a biasing element configured to bias the section towards the first configuration, such that the section is caused to return to the first configuration, when the section is in the second configuration and the change is reversed.

3. The utensil as claimed in claim 2, wherein the material presents an activation force when exposed to the signal, the biasing element is formed of spring steel having a spring modulus less than the activation force.

4. The utensil as claimed in claim 2, wherein the material presents an activation force when exposed to the signal, the biasing element is an elastic media having a modulus less than the activation force.

5. A utensil adapted for more facilely entraining a filament, wherein the filament defines an average cross-sectional diameter, said utensil comprising:

a body including an entraining section, wherein the entraining section, in a first configuration, defines an eye presenting a first dimension, wherein the section comprises an active material operable to undergo a reversible change when exposed to or occluded from an activation signal, so as to be activated and deactivated, respectively, and wherein the section is caused to achieve a second configuration defining an eye presenting a second dimension greater than the diameter, as a result of the change, wherein the utensil is an electrical connector, and the filament is conductive wire.

6. A structure adapted for threading a filament, wherein the filament defines an average cross-sectional diameter, said structure comprising:

a conformal body defining an aperture in a first shape, wherein the aperture presents a first dimension less than the diameter; and a shape memory element drivenly coupled to the body, and operable to undergo a change when exposed to or occluded from an activation signal, so as to be activated and deactivated, respectively, said body and material being cooperatively configured such that the body is caused to conform to a second shape wherein a second dimension greater than the diameter is presented, as a result of the change.

7. The structure as claimed in claim 6, wherein the element is a band comprising shape memory alloy, the band encircles and engages opposite portions of the body, so as to define first areas of engagement, and the body is caused to conform by the contraction of the band, when the alloy is exposed to a thermal heat energy signal.

8. The structure as claimed in claim 7, wherein the structure further includes upper and lower engaging members intermediate the band and body, and the members and body cooperatively define second areas of engagement greater than the first.

9. The structure as claimed in claim 6, wherein the body is attached to an elastic media, and the media composes at least a portion of an article of manufacture selected from the group consisting essentially of clothes, shoes, sporting, boating, and hiking equipment, and cable harnesses.

10. A method of lacing and securing a filament defining an average cross-sectional diameter, said method comprising:

a. positioning the filament adjacent at least one stirrup projecting from a surface, wherein the stirrup comprises a shape memory material, and presents a first configuration wherein a distal edge is defined and spaced from the surface a distance greater than the diameter;

b. exposing the material to or occluding the material from an activation signal, so as to be activated and deactivated, respectively; and c. bending the stirrup so as to autonomously achieve a second configuration, wherein the edge is spaced from the surface a distance less than the diameter, as a result of activating or deactivating the material, so as to apply a holding force to the filament.

* * * * *